US007030713B2

(12) United States Patent
Ralph

(10) Patent No.: US 7,030,713 B2
(45) Date of Patent: Apr. 18, 2006

(54) MINIATURE HIGH PERFORMANCE COUPLER

(75) Inventor: Loren Ralph, Citrus Heights, CA (US)

(73) Assignee: Scientific Components Corporation, Brooklyn, NY (US)

( * ) Notice: Subject to any disclaimer, the term of this patent is extended or adjusted under 35 U.S.C. 154(b) by 51 days.

(21) Appl. No.: 10/794,701

(22) Filed: Mar. 8, 2004

(65) Prior Publication Data

US 2005/0195046 A1 Sep. 8, 2005

(51) Int. Cl.
*H01P 5/12* (2006.01)
*H01P 5/04* (2006.01)

(52) U.S. Cl. ..... 333/111; 333/116

(58) Field of Classification Search ..... 333/26, 333/33, 115, 116, 117, 118, 111
See application file for complete search history.

(56) References Cited

U.S. PATENT DOCUMENTS 3,869,585 A * 3/1975 Snyder ..... 333/118
6,686,812 B1 * 2/2004 Gilbert et al. ..... 333/112
6,765,455 B1 * 7/2004 De Lillo et al. ..... 333/116
6,806,789 B1 * 10/2004 Bawell et al. ..... 333/117
6,819,200 B1 * 11/2004 Zhao et al. ..... 333/26

* cited by examiner

*Primary Examiner*—Dean Takaoka
(74) *Attorney, Agent, or Firm*—Kevin Redmond

(57) ABSTRACT

A coupler that has a small package size and is adjustable after manufacturing. A coupler has a substrate with several dielectric layers and a top and bottom surface. A ground plane is located on the top surface and another ground plane is located on the bottom surface. A pair of coupled circuit lines are located within the substrate. Conductive vias extend between the layers and provide an electrical connection between the ground planes and the circuit lines. The top ground plane has several segments joined by links. The top ground plane can be modified to adjust the coupling between the coupled circuit lines by deleting one or more of the links. The links can be used to adjust the coupling after the coupler has been manufactured.

22 Claims, 12 Drawing Sheets

MINIATURE HIGH PERFORMANCE COUPLER

BACKGROUND OF THE INVENTION

1. Field of the Invention

This invention relates to quadrature couplers in general and more particularly to a quadrature coupler having a small package size.

2. Description of the Prior Art

A quadrature coupler is a four port device. A coupler separates signals based on the direction of signal propagation. These devices are used to unequally split the signal flowing in the mainline and to fully pass the signal flowing in the opposite direction. Referring to FIG. 1, a schematic diagram of a coupler is shown. Coupler 20 has an input port 22 and a through port 25 connected to coupled circuit line 30. An isolated port 24 and a coupled port 23 are connected to coupled circuit line 32. The lines 30 and 32 are broadside coupled lines that are coupled by an electromagnetic field. In an ideal situation some portion of the signal flowing into the input port 22 will appear at coupled port 23. Likewise any signal flowing into coupled port 23 will be coupled fully to input port 22. Isolated port 24 and input port 22 are isolated in that any signal flowing into port 22 will not appear at port 24 but will feed through to port 25.

For a 3 dB quadrature coupler, the amplitudes at coupled port 23 and through port 25 are 3 dB lower than at the input port 22. The phase difference between the input port 22 and ports 23 and 25 is ninety degrees. A differential (Zoo) and common (Zoe) mode impedance is associated with the quadrature coupler.

Couplers are typically mounted to a printed circuit board along with other electronic components. Prior art couplers have suffered from taking up excessive printed circuit board space. The space problem is worse when several couplers are required such as for a vector modulator or a balance amplifier. A quadrature coupler of the prior art has typical dimensions of 0.35 by 0.56 by 0.08 inches. These couplers are manufactured using a Teflon dielectric. Unfortunately, Teflon expands and contracts excessively due to temperature changes. Attempts have been made to make smaller couplers with Teflon. However, they have suffered from very poor electrical performance below 2 GHz.

Current couplers also do not allow the coupling to be adjusted after the coupler has been built.

Other types of prior art couplers have also been made with ferrite transformers along with appropriate resistors and capacitors arranged around the ferrite transformer. When these components are packaged together, they can take up a large amount of space. Placing resistors, capacitors and transformers complicates assembly using automated surface mount assembly equipment.

While couplers have been used, they have suffered from poor performance, a large size and in being difficult to assemble. A current unmet need exists for a coupler that is smaller, has high performance and is easily assembled.

SUMMARY

It is a feature of the invention to provide a coupler having a small package size with good electrical characteristics.

Another feature of the invention is to provide a coupler that includes a substrate having several dielectric layers and a top and bottom surface. A ground plane is located on the top surface and another ground plane is located on the bottom surface. A pair of coupled circuit lines are located within the substrate. Conductive vias extend between the layers and provide an electrical connection between the ground planes and the circuit lines.

Another feature of the invention is to provide a ground plane having several segments joined by links, the ground plane is adapted to be modified to adjust the coupling between the coupled circuit lines. The links can be used to adjust the coupling after the coupler has been manufactured.

BRIEF DESCRIPTION OF THE DRAWINGS

In order that the invention may be more fully understood, it will now be described with reference to the accompanying drawings in which.

It is noted that the drawings of the invention are not to scale. In the drawings, like numbering represents like elements between the drawings.

DETAILED DESCRIPTION

Figure 1:
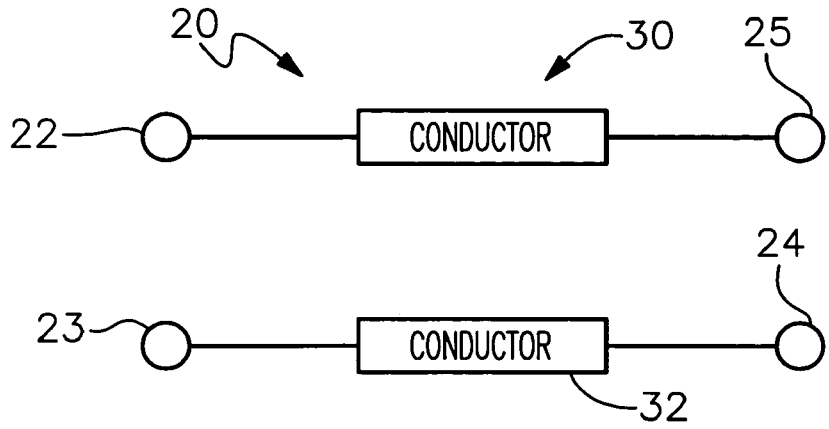
FIG. 1 is a schematic diagram of a coupler.
Figure 2:
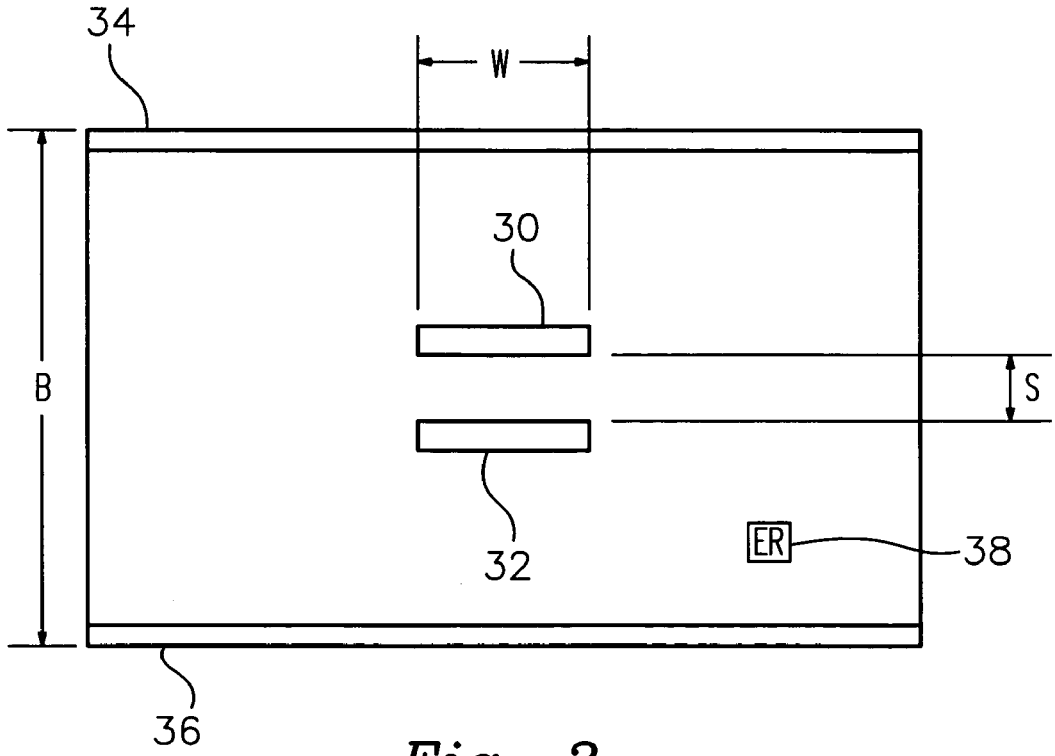
FIG. 2 is side cross sectional view of a pair of coupled lines in a dielectric medium.

Referring to FIG. 2, a side cross sectional view of a pair of coupled circuit lines in a dielectric medium is shown. Coupled lines 30 and 32 are buried side by side inside a dielectric material 38. The coupled circuit lines have a width W. The coupled circuit lines are spaced apart by a dimension S. The dielectric 38 has a thickness B. A top ground plate 34 is located on top of dielectric 38 and a bottom ground plate 36 is located below dielectric 38. The dielectric material has an associated dielectric constant. Differential (Zoo) and common (Zoe) mode impedances are determined by the spacing between the ground planes B, the width of the lines W, the spacing between the lines S and the dielectric constant of dielectric material 38.

Figure 3:
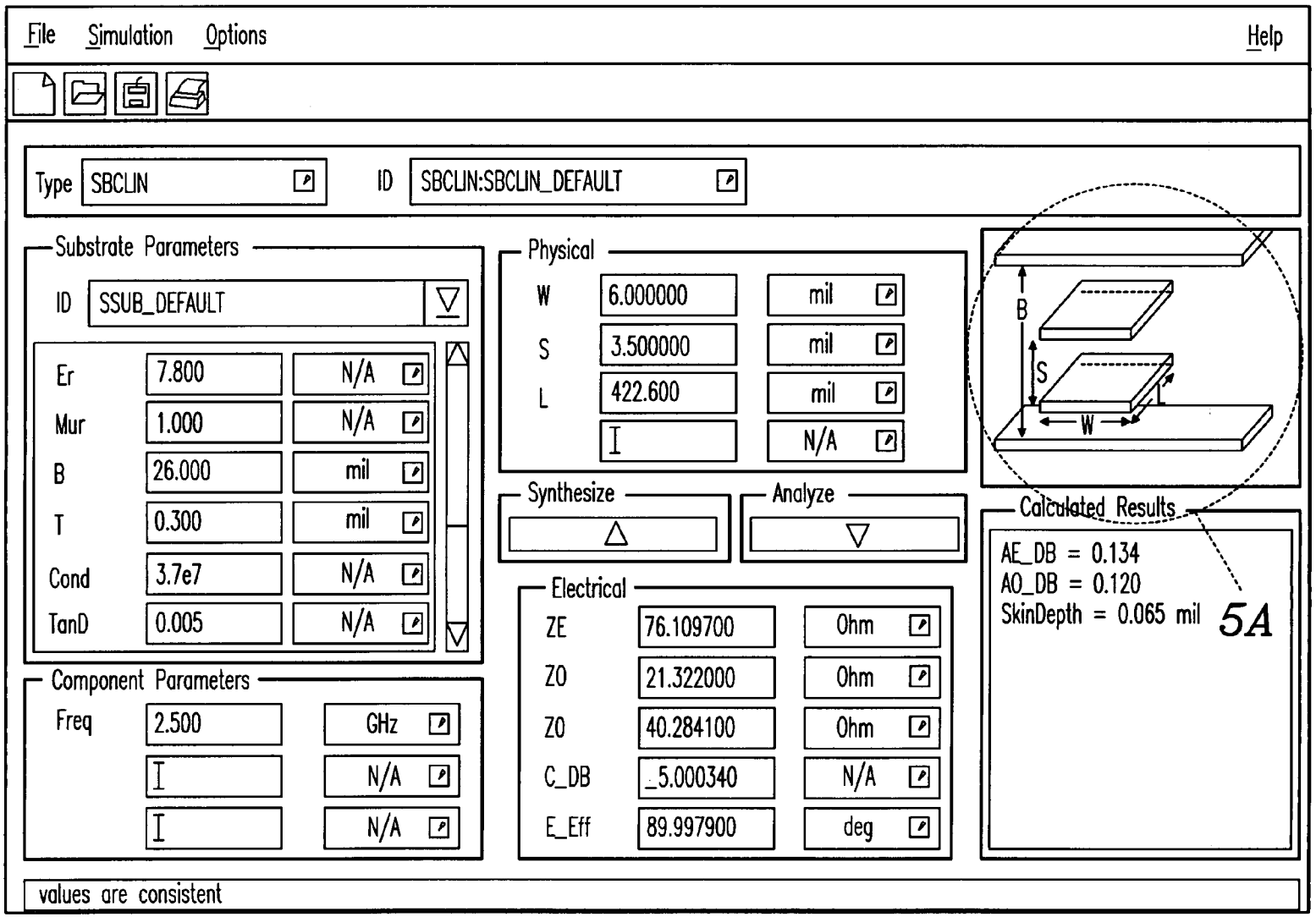
FIG. 3 is computer simulation of the structure of FIG. 2.

Turning to FIG. 3, a computer simulation of the structure of FIG. 2 with preferred line dimensions and layer thicknesses is shown. The dielectric material used was a low temperature co-fired ceramic material (LTCC). The line width W was set to 6.0 mils, the line spacing S was set to 3.5 mils and the dielectric thickness was set to 26.0 mils with a dielectric constant of 7.8. These dimensions can be readily manufactured using commercially available technology. The results of the simulation produced a common mode impedance (Zoe) of 76.1 ohms and a differential mode impedance (Zoo) of 21.3 ohms. The regular impedance (Z0) was 40 ohms. The coupling value was 5.0 dB.

For a 3 dB quadrature coupler with a reference impedance of 50 ohms, the required value of differential mode impedance (Zoo) is 20.7 ohms and the required common mode impedance (Zoe) is 120.9 ohms. Therefore, some changes to the dimensions that were simulated are necessary. The differential mode impedance is close to the required value. However, the common mode impedance is too low. Common mode impedance is dependent upon the inductance per unit length of the coupled lines.

Figure 4:
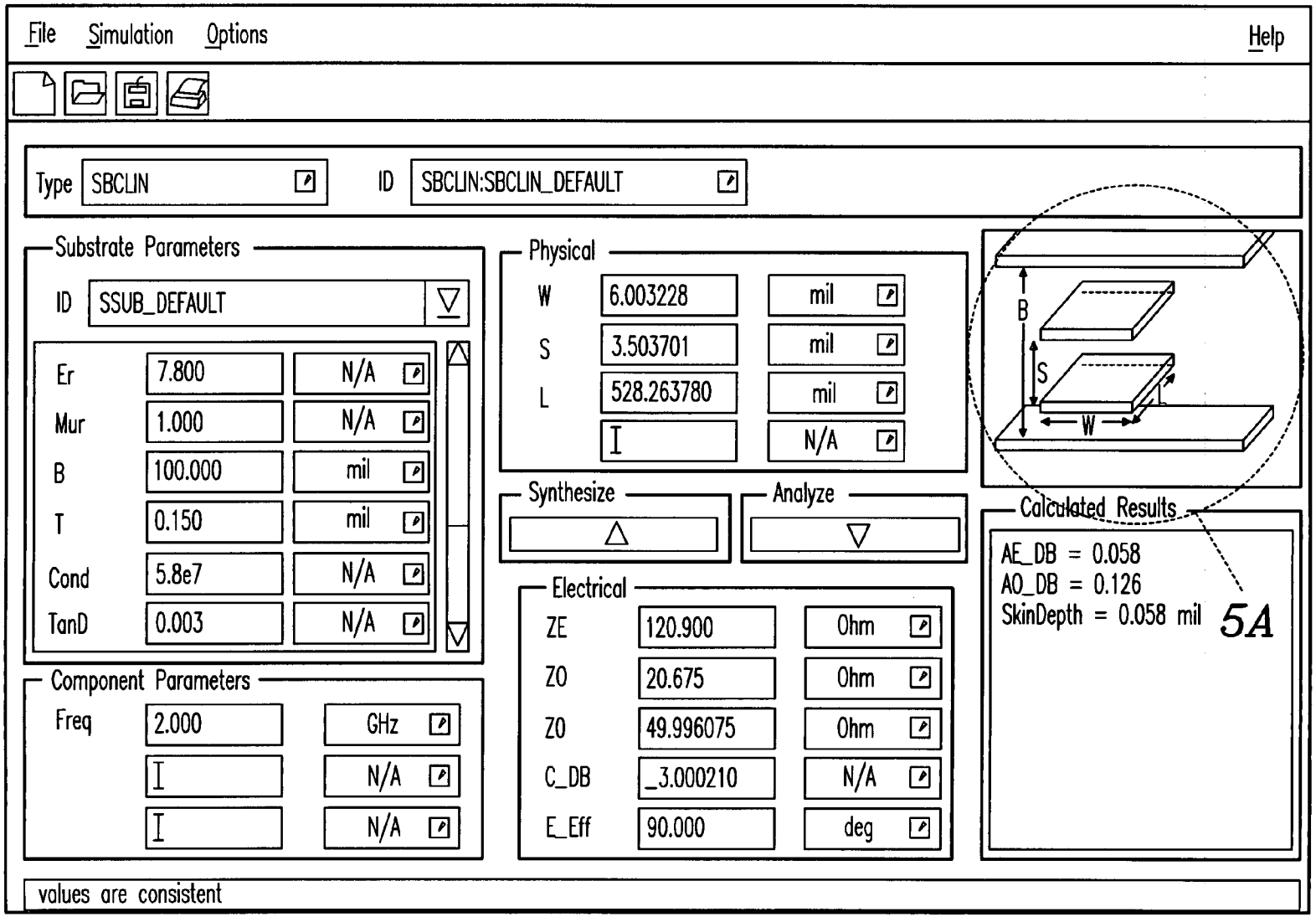
FIG. 4 is another computer simulation of the structure of FIG. 2.

Referring to FIG. 4, another computer simulation of the structure of FIG. 2 is shown. In FIG. 4, the dimensions used in the simulation have been changed to those required to produce the required common and differential mode impedances.

The line width W was set to 6.0 mils, the line spacing S was set to 3.5 mils and the dielectric thickness was set to 100.0 mils with a dielectric constant of 7.8. The results of the simulation produced a differential mode impedance (Zoo) of 20.6 ohms and a common mode impedance (Zoe) of 120.9 ohms. The regular impedance (Z0) was 50 ohms.

While, the simulation produced the correct impedances with line widths and spacings that are manufacturable. The required dielectric thickness of 100 mils is 4 times larger than what is desired or currently available.

Figure 5:
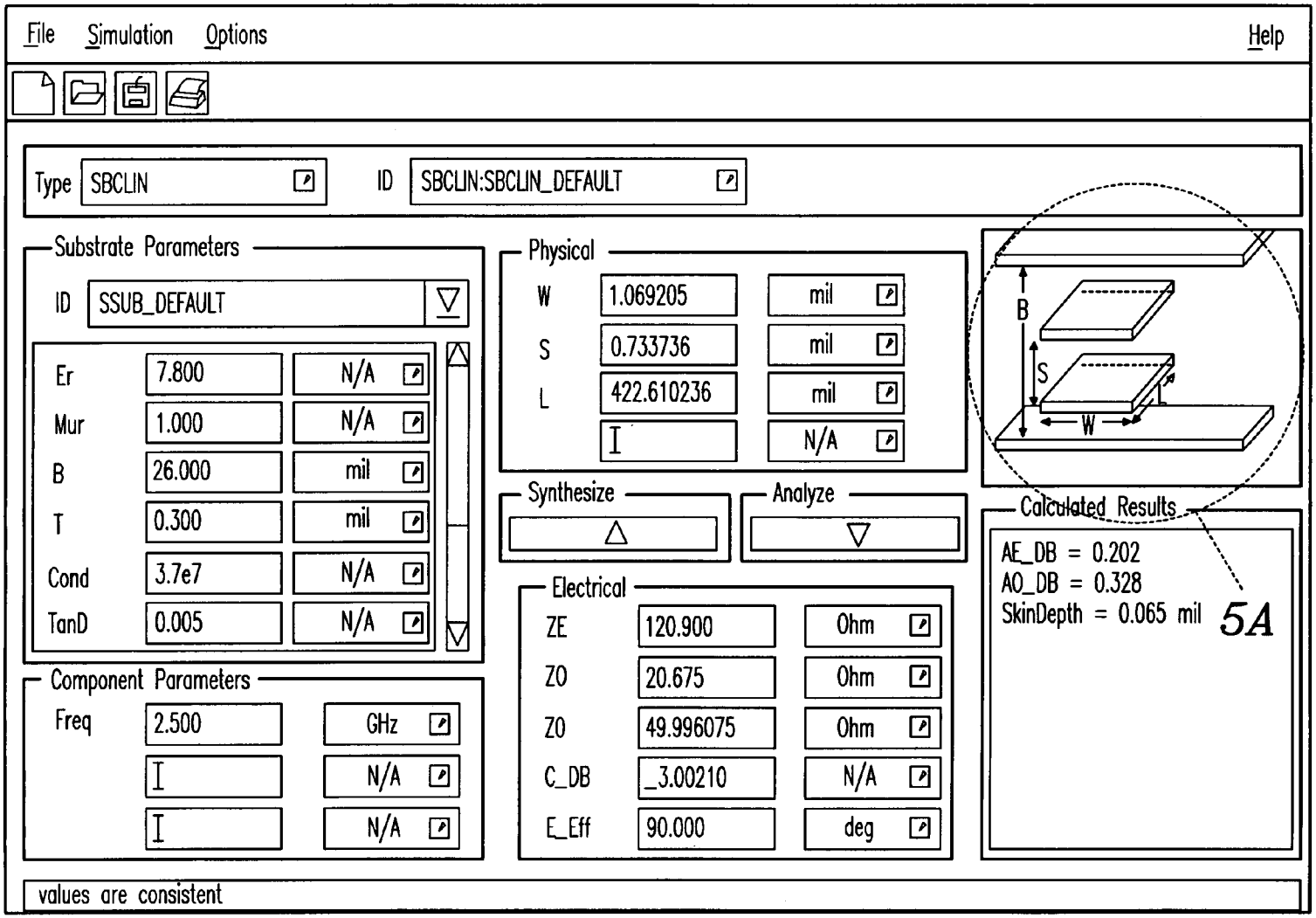
FIG. 5 is another computer simulation of the structure of FIG. 2.
Figure 5A:
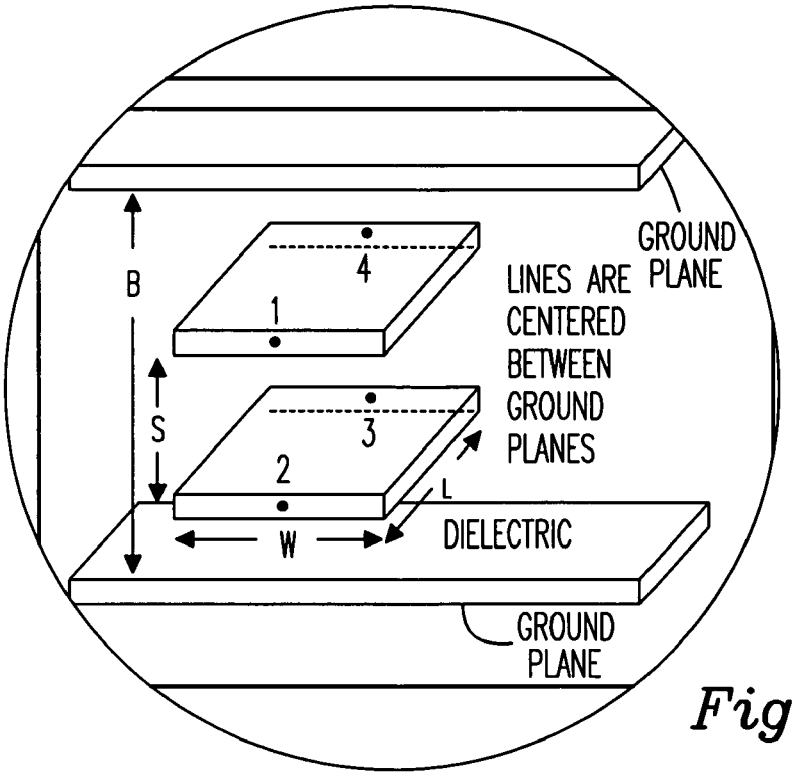

Referring to FIG. 5, another computer simulation of the structure of FIG. 2 is shown. In FIG. 5, the dimensions used in the simulation have been changed to those required to produce the required common and differential mode impedances with a dielectric thickness that is currently manufacturable.

The line width W was set to 1.06 mils, the line spacing S was set to 0.73 mils and the dielectric thickness was set to 26.0 mils with a dielectric constant of 7.8. The results of the simulation produced a differential mode impedance (Zoo) of 20.6 ohms and a common mode impedance (Zoe) of 120.9 ohms. The regular impedance (Z0) was 50 ohms.

While, the simulation produced the correct impedances with a dielectric thickness that is manufacturable. The line widths and spacings are too small to be produced using commonly available technology. The required line width of 1.06 mils is 6 times smaller that what can currently be manufactured using low temperature co-fired ceramic technology.

Figure 7:
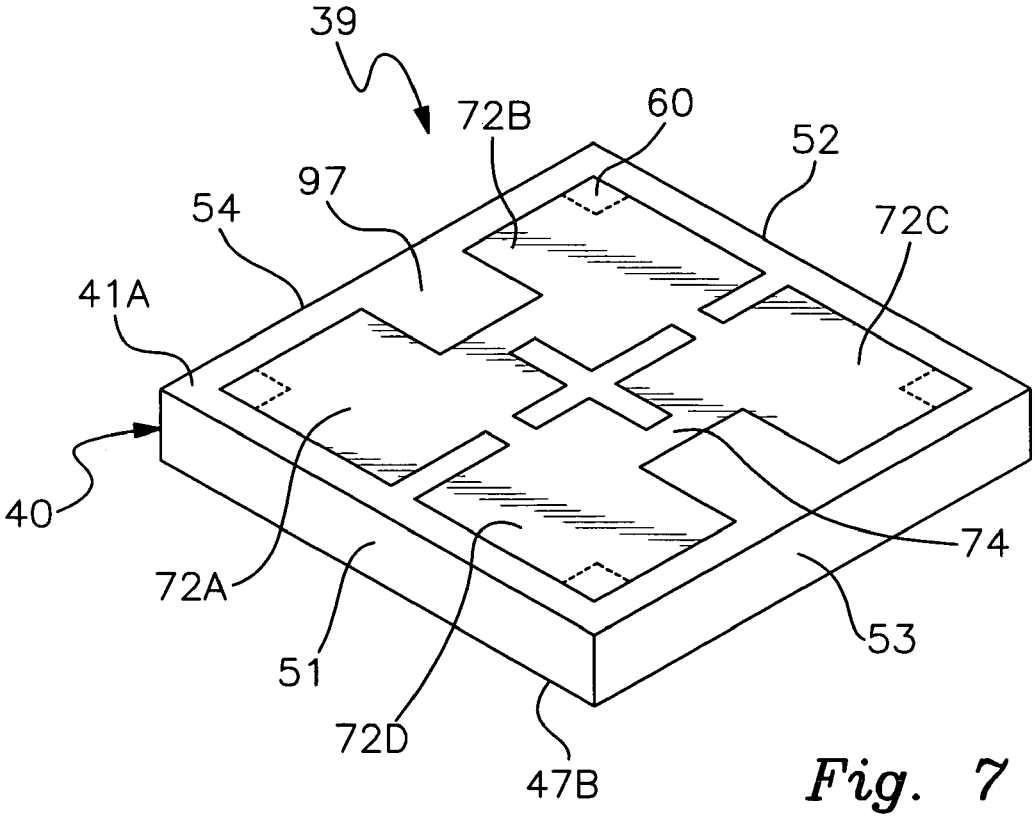
FIG. 7 is an assembled perspective view of FIG. 6.
Figure 6:
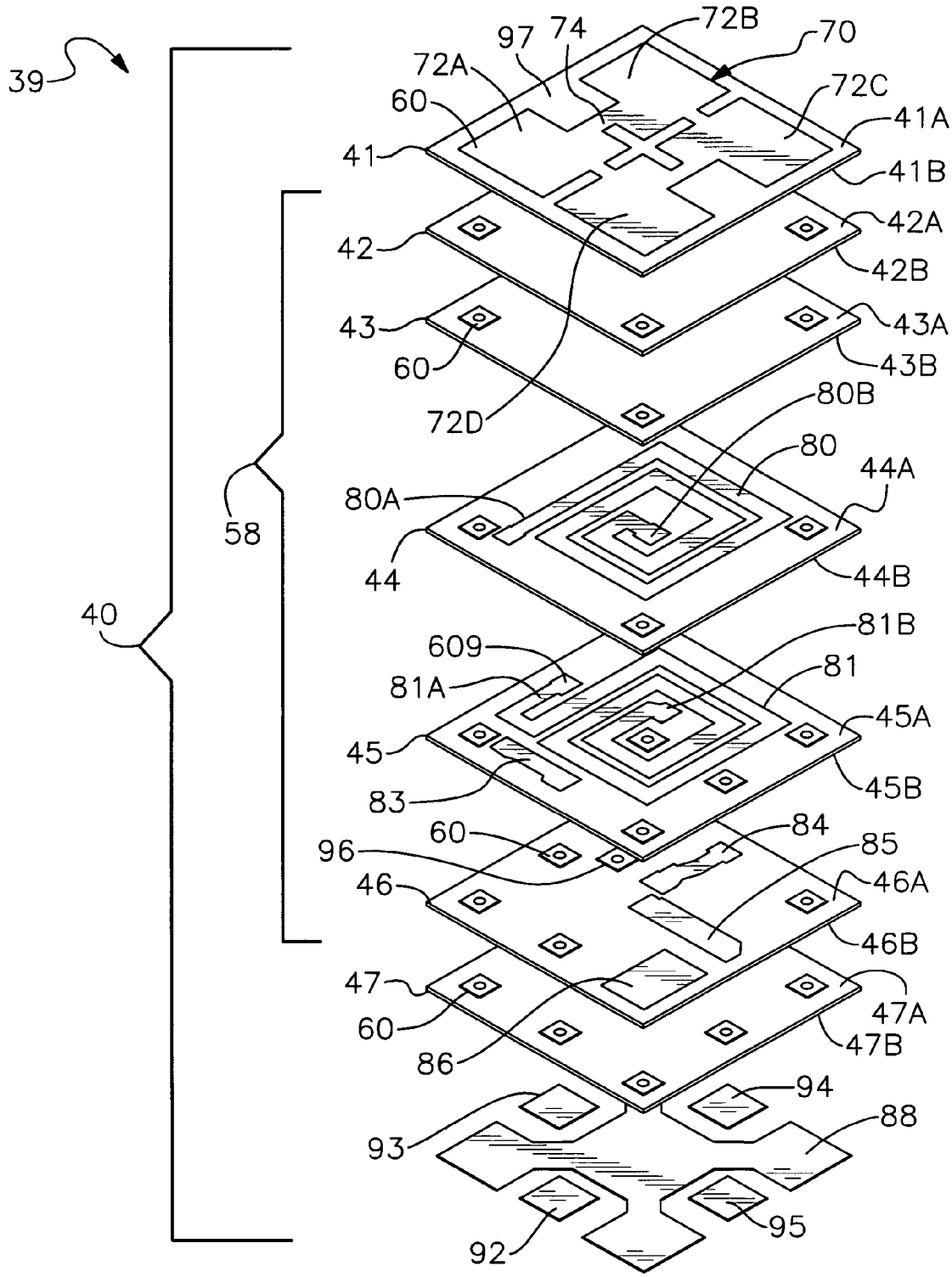
FIG. 6 is an exploded perspective view of a Miniature High Performance Coupler in accordance with the present invention.

FIGS. 6 and 7 show a Miniature High Performance Coupler in accordance with the present invention. Quadrature coupler 39 has a planar low temperature co-fired ceramic (LTCC) structure or substrate 40. Substrate 40 is comprised of multiple layers of low temperature co-fired ceramic material. There are seven LTCC layers in total. Substrate 40 has six outer surfaces including a top surface 41A, bottom surface 47B and four side surfaces 51, 52, 53 and 54. Top and bottom surfaces 41A and 47B are substantially parallel and located on opposing sides of substrate 40. Similarly, sides 51 and 52 are parallel, as are sides 53 and 54.

Planar layers 41, 42, 43, 44, 45, 46 and 47 are all stacked on top of each other and form a unitary structure 40 after firing in an oven. Layer 41 is the top layer, layer 47 is the bottom layer and layers 42, 43, 44, 45 and 46 form inner layers 58. Layers 41–47 are commercially available in the form of a green unfired tape. Each of the layers has a top surface 41A, 42A, 43A, 44A, 45A, 46A and 47A. Similarly, each of the layers has a bottom surface 41B, 42B, 43B, 44B, 45B, 46B and 47B. The layers have several circuit features that are patterned on the surfaces. Multiple vias 60 extend through each of the layers. Vias 60 are formed from an electrically conductive material and electrically connect the circuit features on one layer to the circuit features on another layer.

Layer 41 has several circuit features that are patterned on surface 41A. Surface 41A has a ground plane 70. Ground plane 70 is made up of four ground plane segments 72A, 72B, 72C and 72D. The ground plane segments are interconnected by links 74. Layers 42 and 43 only have vias 60 extending through them. Layer 44 has an electrically conductive coupled circuit line 80 patterned on surface 44A. Circuit line 80 has a spiral or circular shape. Circuit line 80 has ends 80A and 80B. Ends 80A and 80B are connected to different vias 60. Similarly, layer 45 has a coupled circuit line 81 patterned on surface 45A. Circuit line 81 has a spiral or circular shape. Circuit line 81 has ends 81A and 81B. Ends 81A and 81B are connected to different vias 60. A connecting line 83 is located on surface 45A. Connecting line 83 makes an electrical connection between two different vias 60 that are not in the same vertical plane.

The circuit lines 80 and 81 are formed from a conductive metal material. Circuit lines 80 and 81 are capacitively and inductively coupled to each other through the ceramic dielectric layer 44 that is in between. Circuit lines 80 and 81 are arranged on top of each other or co-axial to each other on different layers.

Layer 46 has connecting lines 84 and 85 located on surface 46A. A ground plate 86 and adjust conductor 96 are located on surface 46A. Ground plate 86 and adjust conductor 96 are connected to ground through vias 60. Layer 47 has no circuit features on surface 47A. The circuit features on layer 47 are located on bottom surface 47B. Surface 47B has a bottom ground plane 88 and terminals or ports 92, 93, 94 and 95.

Input port 92, coupled port 93, isolated port 94 and through port 95 are located between portions of ground plane 88. Bottom ground plane 88 is connected to top ground plane 70 and ground plate 86 by four vias 60 at each corner. The size of ports or terminals 92–95 and the spacing between the ports and the adjacent ground plane 88 are optimized to an impedance of 50 ohms when soldered on to a printed circuit board.

Input port 92 is connected through a via 60 and connecting line 83 to end 80A. Coupled port 93 is connected through a via 60 to end 81A. Isolated port 94 is connected through a via 60 and connecting line 84 to end 81B. Through port 95 is connected through a via 60 and connecting line 85 to end 80B.

Coupler 39 is typically soldered to a printed circuit board that contains other electronic components. The ports or terminals 92, 93, 94, 95 and ground plane 88 on bottom surface 47B would be attached to the printed circuit board using a reflowed solder paste.

Using the spiral shaped circuit lines 80 and 81 increases the inductance of the coupled lines. The length of the spirals is chosen to achieve the desired frequency of operation. Since, the circuit lines need to be terminated and the length of the circuit lines is determined by the frequency of operation, the desired common mode impedance cannot be achieved using only the circuit lines.

The top ground plane is shaped or patterned to alter the coupling of the circuit lines in order to obtain the proper impedances. Ground plane 70 is shaped using segments 72 and links 74 in order to perform a coarse adjustment of the coupling between circuit lines 80 and 81. If ground plane 70 was solid, without the segments or links, the common mode impedance would be too low for sufficient coupling.

After coupler 39 is made, segments 72 can be disconnected from ground by using a laser to open one or more of the links 74. Alternatively, the segments could also be connected to ground using a wire bond jumper. The shape of the bottom ground plane 88 is determined by the locations where it has to be mounted to a printed circuit board.

Adjusting the top ground plane 70, effects the phase unbalance of the coupler. The phase unbalance is desired to be 90 degrees. A fine adjustment of the coupling between circuit lines 80 and 81 is done using ground plate 86 and adjust conductor 96. While the ground plate 86 was shown on layer 46, it could be placed on other layers and have other sizes to obtain the desired impedance values. The size and shape of the ground planes, ground plate and adjust conductor can be determined using an iterative process with electromagnetic simulation software.

An opening 97, on top surface 41A can be provided for the addition of other electronic components (not shown) on the coupler 39 package. These other electronic components would be connected to the ports through vias 60.

For a 3 dB quadrature coupler, circuit lines 80 and 81 were placed on the top surface of layers 44 and 45. For reduced coupling, circuit line 81 could be placed on the top surface of layer 46 and circuit line 80 could be placed on the top surface of layer 43. This would require adjustments to the connecting lines 83, 84, 85 and adjust conductor 96.

The circuit features of vias, circuit lines, terminals and ground planes are formed by screening a conventional thick film paste material and firing in an oven. First, the low temperature co-fired ceramic layers have via holes punched, the vias are then filled with a conductive material. Next, the circuit features are screened onto the layers. The circuit features are formed with a conductive material. The layers are then aligned and stacked on top of each other to form substrate 40. Substrate 40 is then fired in an oven at approximately 900 degrees centigrade to form a single solid block.

Repeatability of electrical performance is a prime concern for electrical design engineers. Fabricating the coupler using an LTCC process results in a more uniform electrical performance for the resulting coupler. While coupler 39 was shown using 7 layers, it is contemplated that more or fewer layers could be used.

Figure 8:
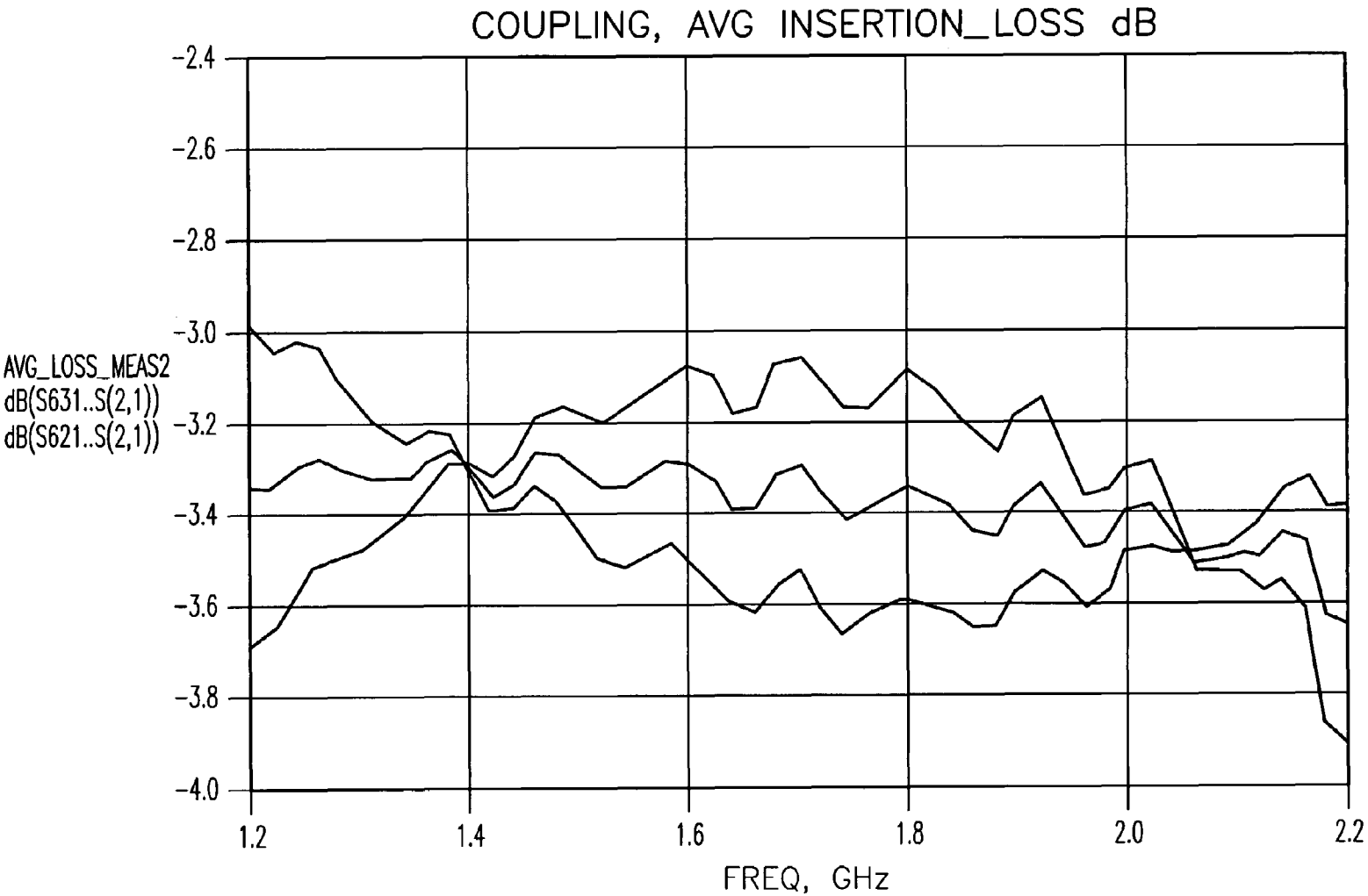
FIG. 8 is a graph showing amplitude unbalance for the coupler of FIGS. 6 and 7.
Figure 9:
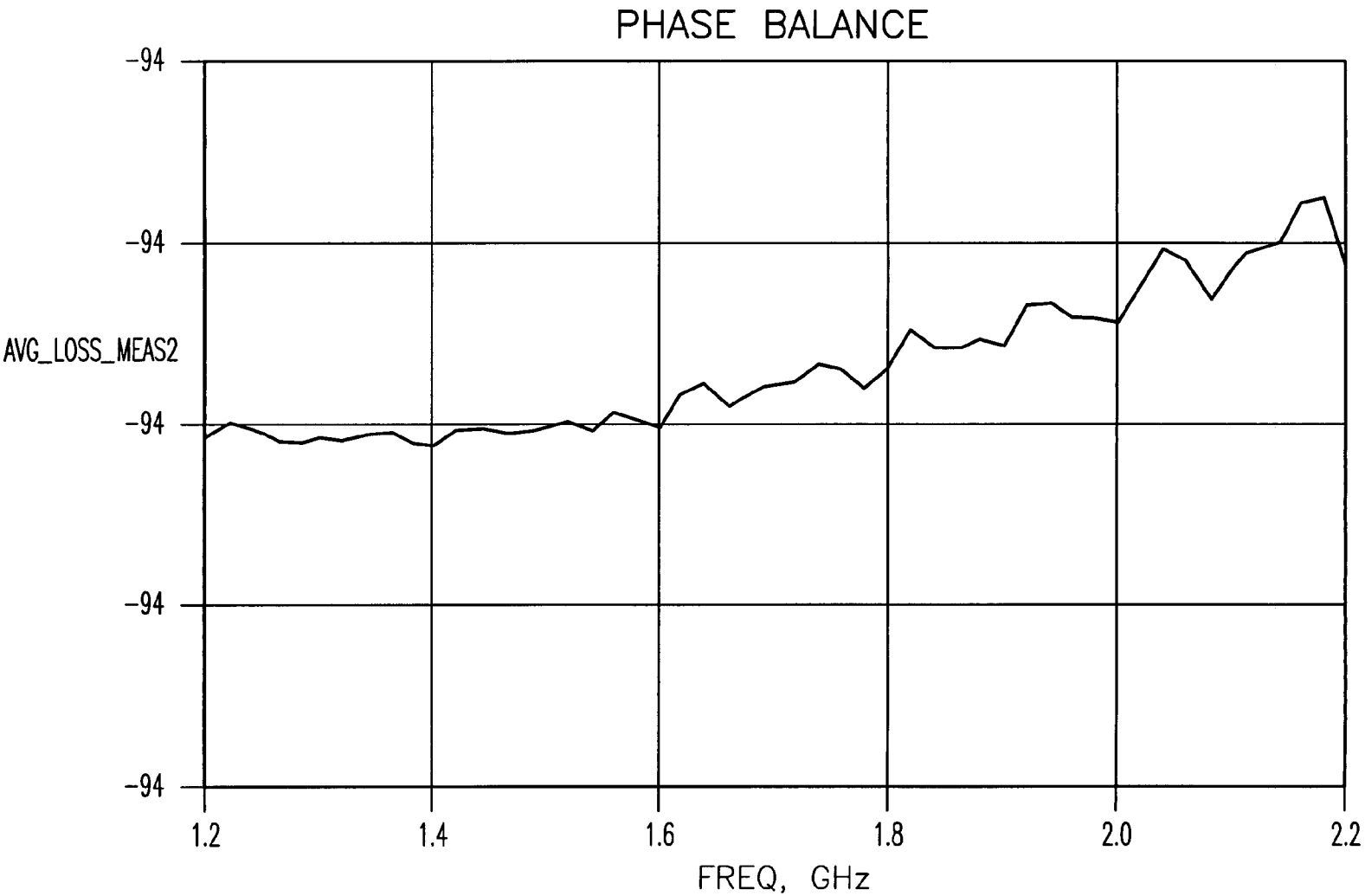
FIG. 9 is a graph showing phase unbalance for the coupler of FIGS. 6 and 7.

FIGS. 8–10 show electrical performance data for a coupler 39 made in accordance with the present invention. The coupler had an overall size of 0.15 by 0.15 by 0.026 inches. FIG. 8 shows a graph of amplitude unbalance over a frequency range of 1.2 GHz to 2.2 GHz. FIG. 9 is a graph showing phase unbalance for the coupler. FIGS. 10A–D are graphs of insertion loss versus frequency for four different top ground plane 70 designs. Links 74 are removed to delete individual ground segments 72.

Figure 10A:
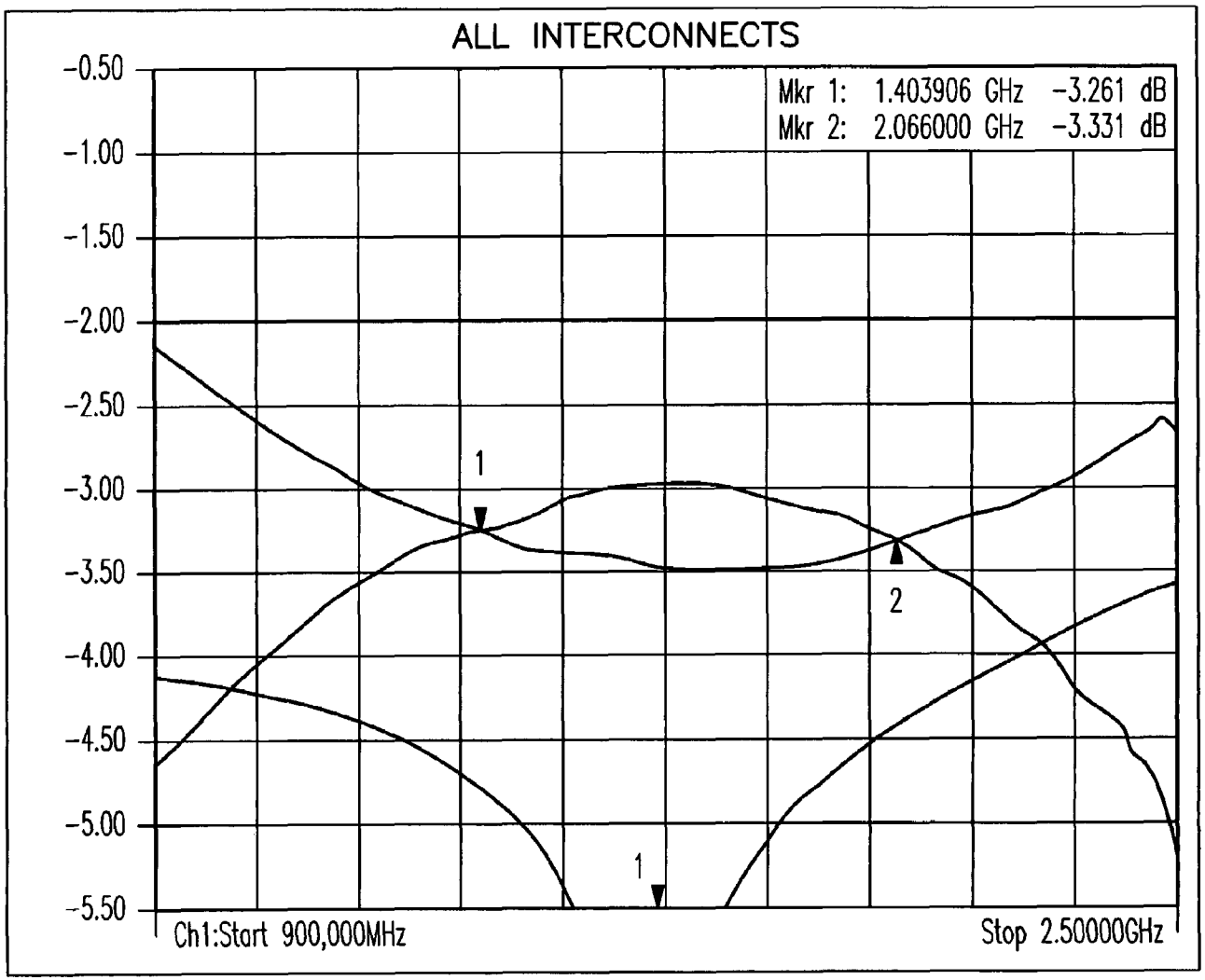
FIG. 10A is a graph of insertion loss versus frequency for a ground plane design with 4 ground segments connected to ground.
Figure 10B:
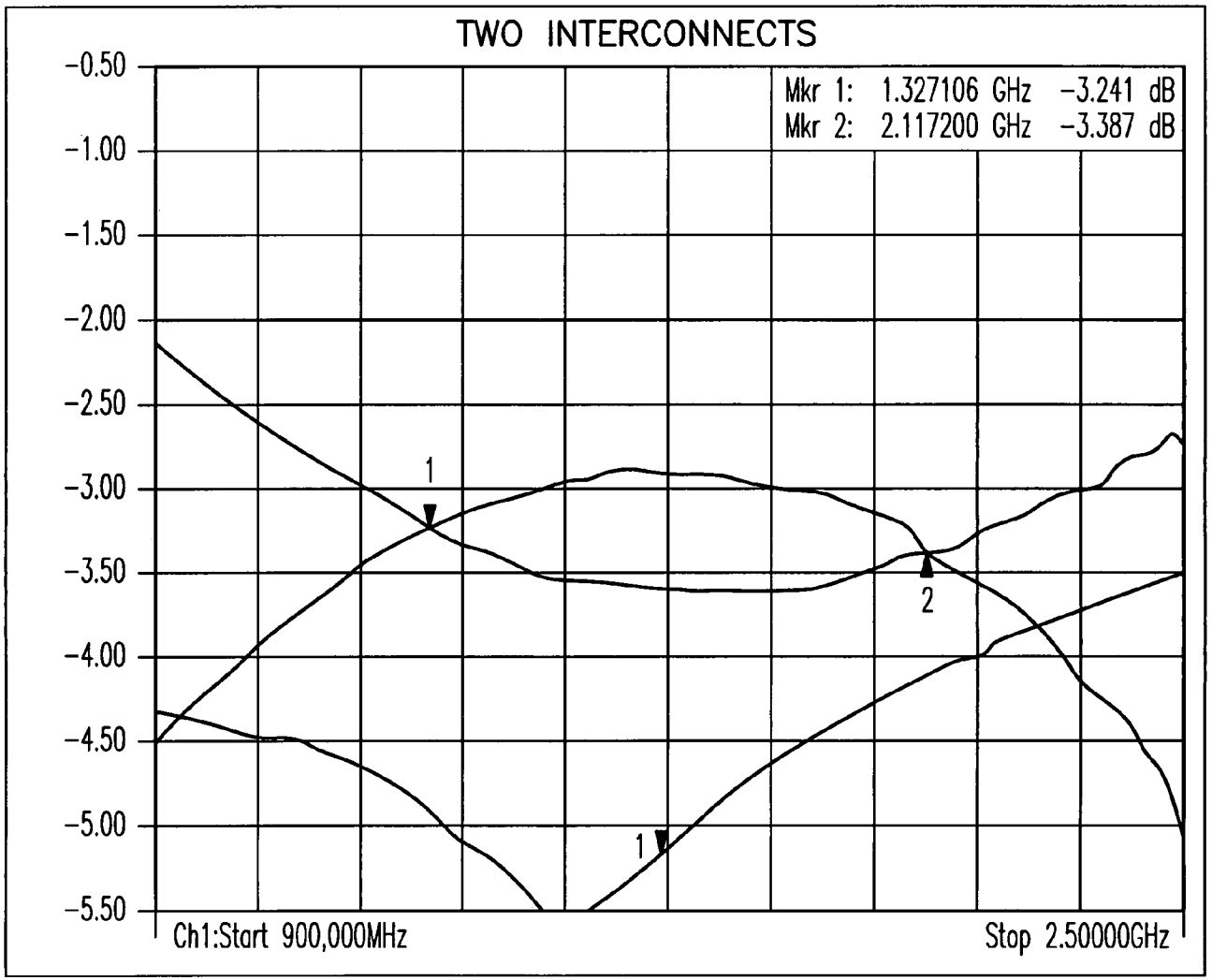
FIG. 10B is a graph of insertion loss versus frequency for a ground plane design with 2 ground segments connected to ground.
Figure 10C:
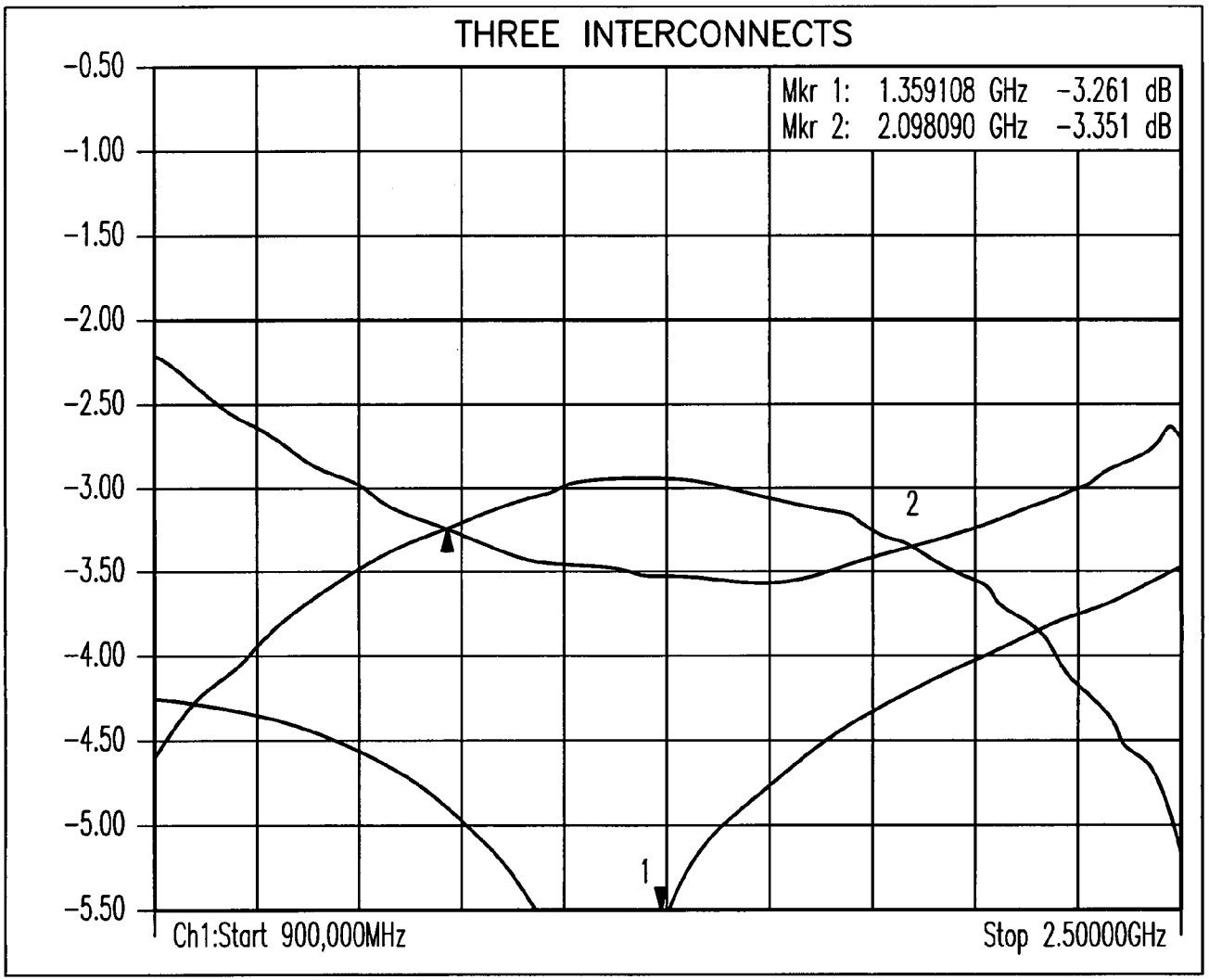
FIG. 10C is a graph of insertion loss versus frequency for a ground plane design with 3 ground segments connected to ground.
Figure 10D:
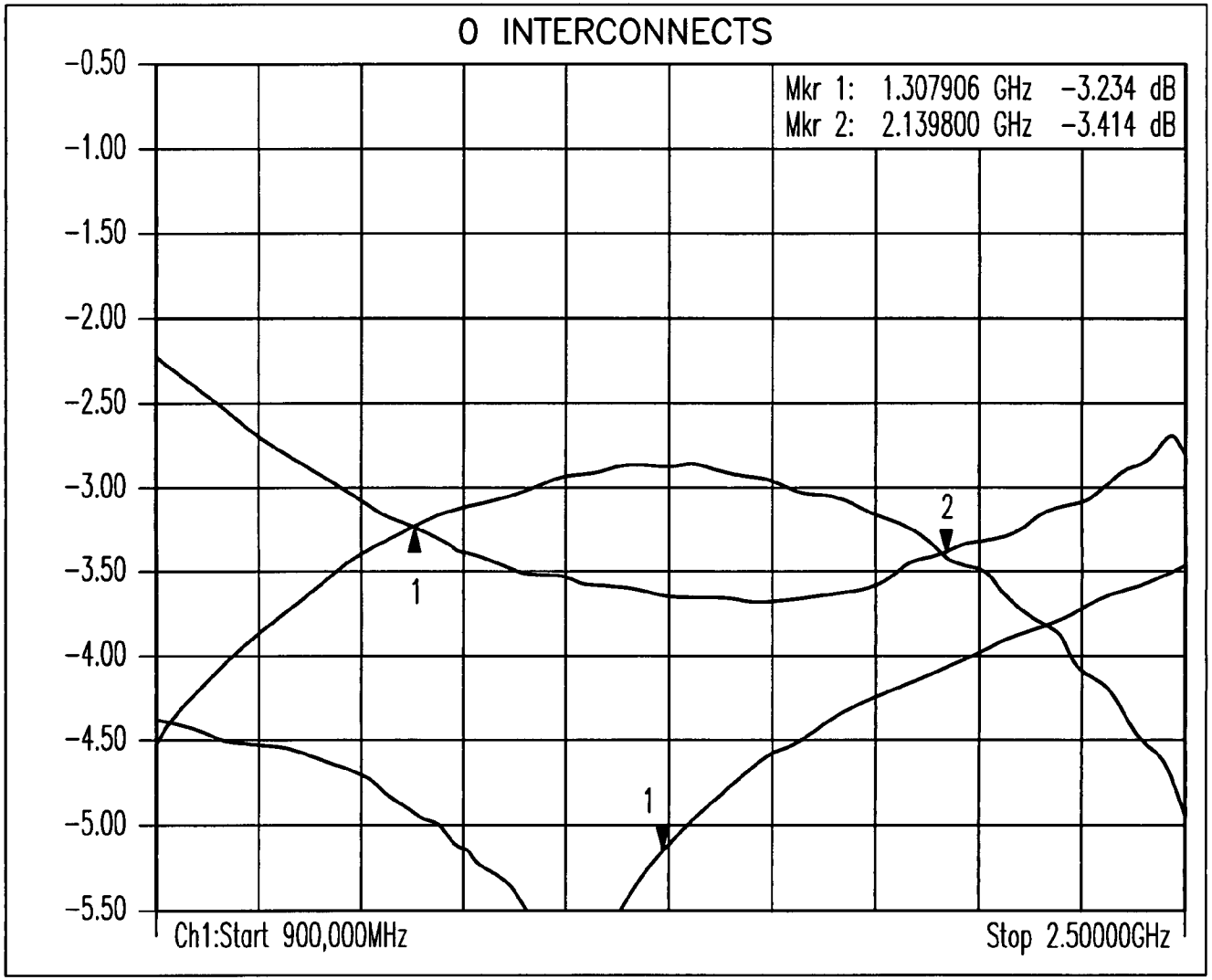
FIG. 10D is a graph of insertion loss versus frequency for a ground plane design with 0 ground segments connected to ground.

FIG. 10A shows ground plane 70 with 4 ground segments 72 connected to ground. FIG. 10B shows ground plane 70 with 2 ground segments 72 connected to ground. FIG. 10C shows ground plane 70 with 3 ground segments 72 connected to ground. FIG. 10D shows ground plane 70 with none of the ground segments 72 connected to ground.

The present invention has many advantages. The use of links 74 and ground segments 72 allows the coupling between the circuit lines and therefore the impedances of the coupler to be adjusted after the manufacturing of the coupler has been completed. Another advantage of the present invention is the use of ground plate 86 and adjust conductor 96. Ground plate 86 and adjust conductor 96 allow the coupling of the circuit lines to be finely adjusted. Another advantage of the present invention is the use of ground plane 70. Ground plane 70 allows the coupling of the circuit lines to be coarsely adjusted. A further advantage of the present invention is that the design of coupler 39 allows for precise values of common mode and differential mode impedance to be obtained.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. A coupler comprising:

a) a substrate having a plurality of dielectric layers and a top and bottom surface;

b) a first ground plane located on the top surface, the first ground plane having a plurality of segments, wherein the segments are connected by a link that is adapted to be deleted;

c) a second ground plane located on the bottom surface;

d) a pair of coupled circuit lines located within the substrate wherein the coupling of the circuit lines can be adjusted by deleting the link; and e) a plurality of conductive vias extending between the layers for providing an electrical connection between the ground planes and the circuit lines.

2. The coupler according to claim 1 wherein the substrate is formed from layers of low temperature co-fired ceramic.

3. The coupler according to claim 1 wherein the circuit lines include a first circuit line and a second circuit line.

4. The coupler according to claim 3 wherein the first circuit line is located on a first layer and the second circuit line is located on a second layer, at least one of the dielectric layers located between the first and second circuit lines.

5. The coupler according to claim 1 wherein the circuit lines have a spiral shape.

6. The coupler according to claim 1 wherein at least one terminal is located on the bottom surface, the terminal connected to one of the vias.

7. The coupler according to claim 1 wherein a ground plate is located on an inner dielectric layer.

8. A quadrature coupler comprising:

a multi-layered low temperature co-fired ceramic substrate, the substrate having a top surface and a bottom surface located on a pair of outer layers and a plurality of inner layers;

an input port, a coupled port, a through port and an isolated port located on the bottom surface;

a first circuit line located on one of the inner layers, the first circuit line having a first and second end, the first end connected to the input port by a first via, the second end connected to the through port by a second via;

a second circuit line located on another inner layer, the second circuit line having a third and fourth end, the third end connected to the coupled port by a third via, the fourth end connected to the isolated port by a fourth via; and a ground plane located on the top surface, the ground plane adapted to adjust the coupling between the first and second circuit lines.

9. The coupler according to claim 8 wherein a second ground plane is located on the bottom surface.

10. The coupler according to claim 8 wherein the ground plane has a pattern.

11. The coupler according to claim 10 wherein the pattern has a plurality of segments connected by a plurality of links.

12. The coupler according to claim 8 wherein a ground plate is located on one of the inner dielectric layers.

13. The coupler according to claim 12 wherein the ground plane provides a coarse adjustment of coupling and the ground plate provides a fine adjustment of coupling.

14. The coupler according to claim 8 wherein the first and second circuit lines have a spiral shape.

15. A coupler comprising:

a substrate having a first and second surface;

a first ground plane located on the first surface, the first ground plane having a plurality of interconnected segments;

a second ground plane located on the second surface;

a first and second circuit line located within the substrate, the first and second circuit line being electromagnetically coupled to each other, wherein the first ground plane is adapted to adjust the coupling between the first and second circuit lines;

an input port, a coupled port, a through port and an isolated port located on the second surface; and a plurality of conductive vias extending through the substrate, the vias providing an electrical connection between the ground planes, the circuit lines and the ports.

16. The coupler according to claim 15 wherein the segments are connected by a plurality of links.

17. The coupler according to claim 15 wherein the first and second circuit lines have a spiral shape.

18. The coupler according to claim 15 wherein the first circuit line has a first and second end, the second circuit line has a third and fourth end, the ends of the circuit lines being connected to the vias.

19. The coupler according to claim 15 wherein the substrate is formed from a plurality of layers of low temperature co-fired ceramic.

20. The coupler according to claim 19 wherein the first circuit line is located on a first layer and the second circuit line is located on a second layer, at least one of the layers located between the first and second circuit lines.

21. The coupler according to claim 20 wherein a ground plate is located on an inner layer.

22. The coupler according to claim 21 wherein the ground plane provides a coarse adjustment of coupling and the ground plate provides a fine adjustment of coupling.

* * * * *